United States Patent [19]

Simonds, Jr.

[11] 4,028,820

[45] June 14, 1977

[54] HYDRAULIC SYSTEM FOR VEHICLE MOUNTED SNOWPLOW BLADE

[75] Inventor: George D. Simonds, Jr., Mequon, Wis.

[73] Assignee: Douglas Dynamics Corporation, Milwaukee, Wis.

[22] Filed: Dec. 31, 1975

[21] Appl. No.: 645,512

[52] U.S. Cl. ..... 37/41; 172/801; 172/805

[51] Int. Cl.[2] ..... E01H 5/00; E02F 3/76

[58] Field of Search ..... 37/41, 42, 42 VL, 50, 37/117.5; 172/276, 801, 805, 806; 214/133

[56] References Cited

UNITED STATES PATENTS

| | | | |
|---|---|---|---|
| 2,766,536 | 10/1956 | Perkins | 172/805 |
| 2,792,650 | 5/1957 | Kenyon | 37/42 R |
| 3,201,878 | 8/1965 | Markwardt | 37/42 R |
| 3,307,275 | 3/1967 | Simi | 37/42 R |
| 3,539,022 | 11/1970 | Berg | 172/805 |
| 3,640,005 | 2/1972 | Chiarolanza | 37/42 R |
| 3,706,144 | 12/1972 | Miceli | 37/50 X |

FOREIGN PATENTS OR APPLICATIONS

| | | | |
|---|---|---|---|
| 2,201,465 | 7/1973 | Germany | 37/41 |
| 594,390 | 8/1957 | Italy | 37/42 R |

*Primary Examiner*—E. H. Eickholt

[57] ABSTRACT

A hydraulic system for a vehicle mounted snowplow blade capable of lifting, lowering, and angling the blade right or left has a single 4-way valve controlling power flow to the lift and angling cylinders. Power flow to and return flow from the angle cylinders is controlled through the 4-way valve. Power flow to the lift cylinder is controlled through the 4-way valve and return flow from the lift cylinder to the reservoir is controlled through a separate two-way valve. Both valves are electrically operated by means of solenoids connected directly to the valve body.

3 Claims, 4 Drawing Figures

HYDRAULIC SYSTEM FOR VEHICLE MOUNTED SNOWPLOW BLADE

BACKGROUND OF THE INVENTION

This invention relates to vehicle mounted snowplow blades and, more particularly, to hydraulic systems utilized in raising and angling such blades.

Vehicle mounted snowplow blades capable of being angled right or left, in addition to being raised or lowered, are well known. Also, various hydraulic systems and arrangements have been proposed to achieve the lift, lower, and angling operation of the blade. Examples of this type of installation can be found in U.S. Pat. Nos. 3,201,878 and 3,706,144 and in U.S. Pat. No. 3,307,275 assigned to the assignee of this application. The design objectives for such systems have been simplification, compactness, and economy, all without sacrificing the effectiveness and reliability of operation. The aforementioned patent structures, which are typical of prior art proposals, meet some but not all of these design criteria.

It is among the general objects of this invention to simplify the overall hydraulic system as used in these types of installations, to achieve a compact arrangement of the operative elements such as the valves, conduits, etc. and to minimize the number of operative elements required.

SUMMARY OF THE INVENTION

For the achievement of these and other objects, this invention proposes a hydraulic system capable of raising, lowering, and angling a vehicle mounted snowplow blade wherein power flow of hydraulic fluid to the various hydraulic cylinders is controlled through a single valve. This not only reduces the valve assemblies required for the installation but also materially reduces the amount of hydraulic conduits and connections required to complete the system.

In addition to the power flow circuits being established through the single valve, return flow paths are also established from the angle cylinders to the reservoir through that same valve. Preferably, the return flow path from the lift cylinder to the reservoir is established through a separate valve thereby permitting a relatively simplified porting arrangement to be maintained in the principal valve.

The overall system is further simplified by providing solenoid actuators for the principal valve and, where used, the separate return valve for the lift cylinder. The use of solenoids markedly simplifies the operational connections required for the system. The solenoids are attached directly to the valve structure to further simplify the operative connections and maintain overall compactness.

Other objects and advantages will be pointed out in, or be apparent from, the specification and claims, as will obvious modifications of the embodiment shown in the drawings, in which:

DESCRIPTION OF THE PREFERRED EMBODIMENT

Figures 1, 2, 3, 4:
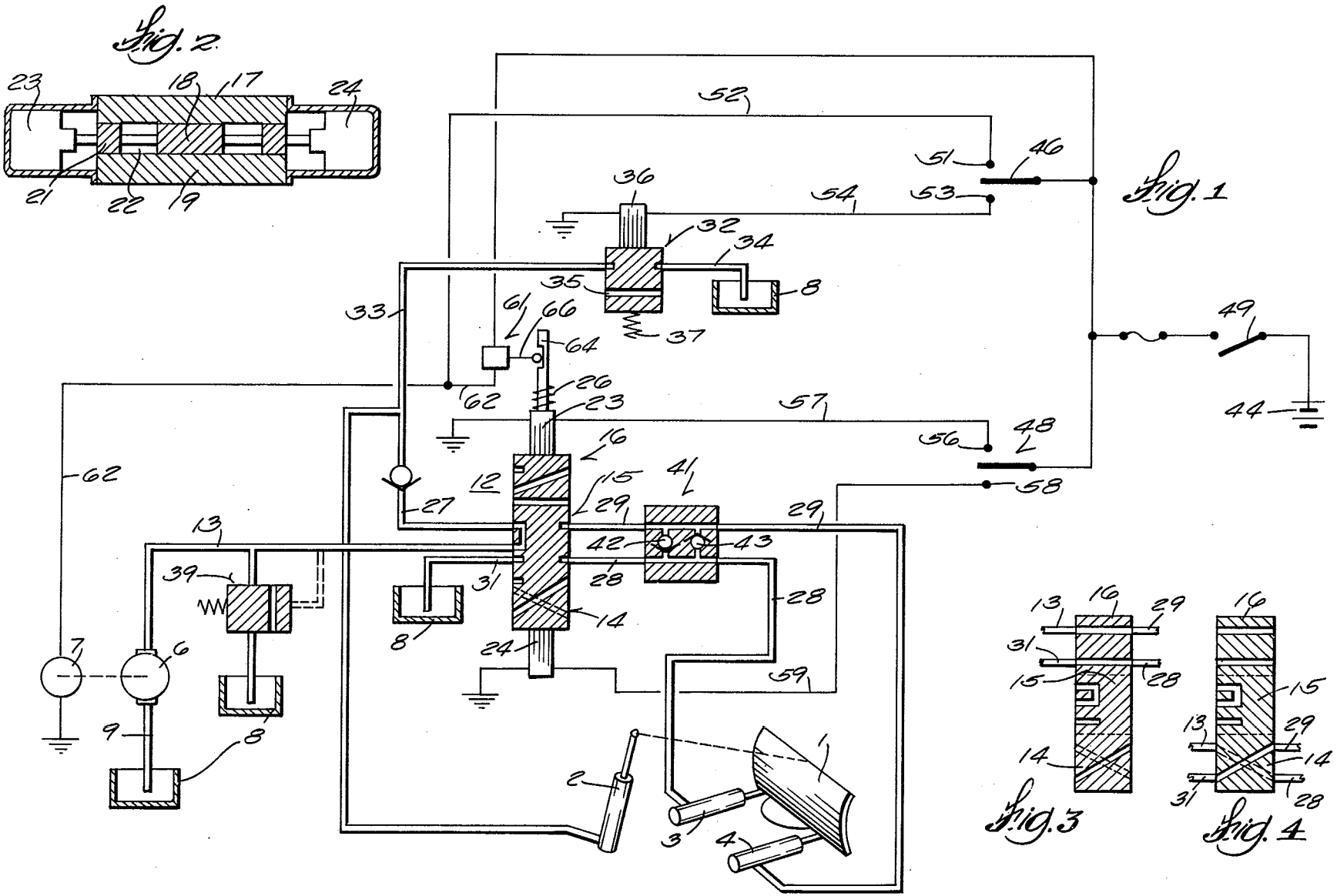
FIG. 1 is a generally schematic view illustrating the hydraulic system and having an electrical circuit superimposed on that system.
FIG. 2 is a general structural illustration of the principal valve.
FIGS. 3 and 4 are schematic views of two additional operative positions of the principal valve.

Snowplow blade 1 is supported from a vehicle (not shown) in a conventional manner. Also, in a conventional manner, the snowplow assembly is connected to a lift cylinder 2 and a pair of angle cylinders 3 and 4. The mounting of the snowplow blade and the connection to the cylinders can take any conventional form and, therefore, specific details have not been illustrated nor will they be described. Should such details become necessary, reliance is placed on the aforementioned U.S. Pat. No. 3,307,275 for such a description.

In the drawing, the hydraulic circuit and elements are illustrated by the double lines and the electrical circuit and elements for the system are illustrated by the single lines. The hydraulic system will be described first.

Pump 6 is driven by an electric motor 7 and draws hydraulic fluid from reservoir 8 through conduit 9. Fluid under pressure is distributed to the hydraulic cylinders through a single valve 12 connected to pump 6 by conduit 13. This supply of hydraulic fluid will be referred to hereinafter as the power flow of the system.

Valve 12 is a 4-way, closed center three position valve and is illustrated schematically in FIG. 1 of the drawings and in a general manner in FIG. 2. With reference to FIG. 2, the valve includes a manifold 17, a movable valve member 18, a cover plate 19 and a ring 21. The manifold, ring and cover plate define a sealed area 22 in which valve member 18 is moved by actuators 23 and 24. As will be described more completely hereinafter, actuators 23 and 24 are solenoid units and also include a spring 26 which causes the valve member 18 to assume the operative state 15 when both solenoids are de-energized. Energization of solenoid 23 establishes operative state 14 and energization of solenoid 24 establishes operative state 16. The actual porting and conduit connections have not been illustrated in FIG. 1 as the schematic illustration and general description should be sufficient to understanding of this invention. Should additional details be required, such details are found in the co-pending application of Jack C. Hill filed Dec. 31, 1975, Ser. No. 645,513 and entitled "Valve" and assigned to the assignee of this invention, reliance is placed on that co-pending application for a further description of the valve should one be required.

Valve 12 is connected to lift cylinder 2 through conduit 27, to angle cylinder 3 through conduit 28 and to angle cylinder 4 through conduit 29. The valve is connected to reservoir 8 through conduit 31.

In the position illustrated in FIG. 1, the valve establishes a power flow circuit from conduit 13 to conduit 27 and on to lift cylinder 2 through conduit 27 in which case the cylinder can be operated to raise the snowplow blade. The return path through conduit 31 is open in this operative state and check valve 25 will hold the blade in the raised position.

When the valve member 18 is shifted to operative state 16 (FIG. 3) conduit 13 communicates with conduit 29 establishing a power flow circuit to angle cylinder 4. At this same time, conduit 28 communicates with reservoir 8 through return conduit 31. In this operative state, fluid under pressure is supplied to cylinder 4 causing the plow blade to angle to the left as viewed in the drawings (counterclockwise). This motion causes the ram of cylinder 3 to be forced into the cylinder and hydraulic fluid is then expelled through conduits 28 and 31 to reservoir 8 to accommodate that motion.

When valve 12 is shifted to operative state 14, a fluid power flow circuit is established from conduits 13 and 28 to cylinder 3, a return flow path being defined from conduit 29 through conduit 13 to reservoir 8. In this state of operation, the power flow circuit causes the ram of cylinder 3 to be extended, angling plow blade 1 to the right causing the ram of cylinder 4 to be retracted into the cylinder. The flow of hydraulic fluid from cylinder 4 is accommodated through conduits 29 and 31 back to reservoir 8.

Accordingly, the power flow circuits for the lift and angle cylinders as well as the return flow circuit for the angle cylinders is provided through the single 4-way valve 12 thereby allowing the hydraulic system to function virtually with a single valve.

In order to maintain a simplified channel and porting arrangement in the basic valve, the return flow for lift cylinder 2 is accomplished exteriorly of the main valve 12. This could be accomplished in any one of a number of ways but preferably is accomplished by connecting lift cylinder 2 to a two-way valve 32 through conduit 33, the two-way valve in turn being connected to reservoir 8 by conduit 34. In the position illustrated in FIG. 1, the two-way valve is closed to flow to the reservoir, operation of the valve by actuating means 36 moves the valve to establish a flow through that valve (in channel 35 which registers between conduits 33 and 34) to establish the return flow path through conduit 34 to reservoir 8. In general terms, actuator 36 is a solenoid unit which is biased by spring 37 to the position illustrated and movable against that bias to register the through channel 35 with conduits 33 and 34 when the solenoid is energized. De-energization of the solenoid automatically returns the valve under the influence of spring 37 to the closed-to-flow position.

Perferably cylinders 2, 3 and 4 are single acting.

With the just described hydraulic arrangement, it will be noted that power flow to the various cylinders is controlled with a minimum of porting and conduit being required.

To complete the hydraulic circuit, it should be noted that a pressure relief valve 39 is included in the circuit and communicates with conduit 13 so that should the pressure in the power flow conduits exceed a given acceptable level, the conduit 13 will automatically be opened to reservoir 8 to relieve the pressure.

A cusion valve 41 of conventional construction, i.e., including parallel arranged check valves 42 and 43, is positioned between conduits 28 and 29. The purpose of the cushion valve is that should plow blade 1 strike an obstruction which would tend to straighten or move the blade, the resultant hydraulic fluid flow which will be produced by that straightening movement is accommodated by flow through the cushion valves. More specifically, if the plow is angled to the left such that ram of cylinder 4 is extended and an obstruction encountered by the plow blade tending to straighten the blade, the ram of cylinder 4 will be retracted into the cylinder and the hydraulic fluid displaced thereby will flow through conduit 29, check valve 43 to cylinder 3 thereby accommodating the unexpected obstruction without damage to either the plow blade or the hydraulic system.

The electrical circuit for the system will now be described. The vehicle battery 44 is connected to the solenoids 23, 24 and 36 through a control switch shown schematically as including a pair of toggle switches 46 and 48. After the vehicle ignition switch 49 has been closed, and with the valve 12 in the position illustrated in FIG. 1, the plow blade can be raised by operating switch 46 to close on contact 51. This completes a circuit through leads 52 and 62 to motor 7 to start the pump and deliver a power flow of fluid to a life cylinder. To lower the lift cylinder, switch 46 is closed on contact 53 which completes a circuit through conductor 54 to solenoid 36 opening valve 32 whereupon the weight of the plow blade causes the ram of the lift cylinder to be retracted and the hydraulic fluid displaced thereby flows back to reservoir 8 through conduits 30 and 33, channel 35 and conduit 34.

Valve 12 can be moved from operative state 15 to operative state 14 by closing switch 48 on contact 56 completing a circuit through conductor 57 to solenoid 23. This moves the slide 18 against spring 26 and positions the valve in operative state 14.

Similarly, to angle the blade to the left, switch 48 is closed on contact 58 completing a circuit through conductor 59 to solenoid 24 to move valve member 18 and establish the operative state 16.

A further electrical feature is included in the electrical circuit and is more particularly described and claimed in the co-pending application of George D. Simonds, Jr. filed Dec. 31, 1975, Ser. No. 645,516 and entitled "Valve and Pump Control for a Hydraulic System" and assigned to the assignee of this application. Generally, that feature includes a limit switch 61 connected in the pump circuit consisting of conductor 62 and switch 61. Switch 61 is operatively associated with an actuator 64 which normally assumes the position illustrated in FIG. 1 when solenoids 23 and 24 are de-energized. In that position, switch 61 is open and the circuit to pump 7 is not completed so that the fluid in the hydraulic system is not under pressure. When one of the operative states 14 or 16 is selected by activation of either solenoid 23 or 24, this de-energization of the pump motor is maintained until the valve member 18 is positioned to establish the particular operative state selected. After that operative state has been established, actuator 64 has engaged plunger 66 of switch 61, closing the switch and completing the circuit to pump motor 7 whereupon the pump initiates the power flow of fluid through valve 12 to the hydraulic cylinder selected. More specific details of the limit switch arrangement, its structures and operation as well as its coordinated operation with valve 12 is contained in the above identified co-pending application and reliance is placed on that application for additional details should they be required.

It will be noted that to start the pump when the valve 12 is in its operative state 15, the separate switch 46 has been provided wherein a circuit through conductor 52 is made bypassing the circuit consisting of switch 61 and conductor 62.

Although but one embodiment of the present invention has been illustrated and described, it will be apparent to those skilled in the art that various changes and modifications may be made therein without departing from the spirit of the invention or from the scope of the appended claims.

I claim:

1. A hydraulic system for selectively raising, lowering, and angling a snowplow blade and comprising, in combination, lift means in the form of a first single acting hydraulic cylinder, angle means in the form of second and third single acting hydraulic cylinders, a pump, hydraulic fluid reservoir, conduit means connecting said pump, reservoir, lift means and angle means for transferring fluid between said reservoir and said lift and angle means, a single valve connected in said conduit means and controlling power fluid flow from said reservoir to said lift means and angle means, said valve having a plurality of operative states, a first operative state connecting said pump to said lift means and being movable from said first state to connect said pump to said angle means, actuating means connected to said valve for manipulating said valve to achieve a selective one of said operating states, valve means separate from said single valve, conduit means defining a flow from said lift cylinder through said valve means to said reservoir separate from said single valve, and actuating means for said valve means selectively operable to close said valve means and interrupt flow to said reservoir and open said valve means to permit flow to said reservoir.

2. The combination of claim 1 wherein said valve has second and third operative states in addition to said first operative state, said second operative state establishes, through said valve, a flow path from said pump to said second cylinder and a return flow path from said third cylinder to said reservoir, said third operative state establishes, through said valve, a flow path from said pump to said third cylinder and a return flow path from said second cylinder to said reservoir, said actuating means for said valve means comprises first and second solenoids and spring means biasing said valve to assume said first operative state when said first and second solenoids are inoperative, said solenoids being selectively operable to move said valve from said first operative state selectively to said second and third operative states.

3. A hydraulic system for selectively raising, lowering, and angling a snowplow blade and comprising, in combination, lift means in the form of a first single acting hydraulic cylinder, angle means in the form of second and third single acting hydraulic cylinders, a pump, hydraulic fluid reservoir, conduit means connecting said pump, reservoir, lift means and angle means for transferring fluid between said reservoir and said lift and angle means, a single valve connected in said conduit means and controlling power fluid flow from said reservoir to said lift means and angle means, said valve having first, second and third operative states and being selectively movable to said operative states, actuating means connected to said valve for manipulating said valve to achieve a selective one of said operative states, said actuating means for said single valve comprising first and second solenoids and spring means biasing said valve to assume said first operative state when said first and second solenoids are inoperative, said solenoids being selectively operable to move said valve from said first operative state selectively to said second and third operative states, in said first operative state said valve connecting said pump to said lift means, in said second operative state said valve establishes, through said valve, a flow path from said pump to said second cylinder and a return flow path from said third cylinder to said reservoir, in said third operative state said valve establishes, through said valve, a flow path from said pump to said third cylinder and a return flow path from said second cylinder to said reservoir, and means defining a return flow from said lift cylinder to said reservoir when said valve is in said first operative state.

* * * * *